US007690305B2

(12) United States Patent
Harjula et al.

(10) Patent No.: US 7,690,305 B2
(45) Date of Patent: Apr. 6, 2010

(54) INCREMENT CHARGE FOR FIN-STABILIZED MORTAR PROJECTILE

(75) Inventors: Timo Pekka Harjula, Tampere (FI); Ville-Pekka Pesonen, Vammala (FI)

(73) Assignee: Patria Vammas Oy, Vammala (FI)

( * ) Notice: Subject to any disclaimer, the term of this patent is extended or adjusted under 35 U.S.C. 154(b) by 390 days.

(21) Appl. No.: 10/979,749

(22) Filed: Nov. 2, 2004

(65) Prior Publication Data

US 2005/0268806 A1 Dec. 8, 2005

(30) Foreign Application Priority Data

Feb. 9, 2004 (FI) ..... 20040194

(51) Int. Cl.
*C06B 45/00* (2006.01)

(52) U.S. Cl. ..... 102/291; 102/490; 102/443; 102/288; 102/373

(58) Field of Classification Search ..... 102/291, 102/490, 443, 288, 373, 283, 292
See application file for complete search history.

(56) References Cited

U.S. PATENT DOCUMENTS

| | | | | |
|---|---|---|---|---|
| 3,124,070 | A * | 3/1964 | Jasse | 102/373 |
| 4,408,534 | A * | 10/1983 | Araki et al. | 102/288 |
| 4,543,885 | A * | 10/1985 | Akhagen et al. | 102/373 |
| 4,549,487 | A * | 10/1985 | Jensen | 102/498 |
| 4,711,180 | A * | 12/1987 | Smolnik | 102/445 |
| 4,898,097 | A * | 2/1990 | Jordan et al. | 102/283 |
| 6,837,164 | B1 * | 1/2005 | Khanna et al. | 102/373 |
| 7,024,998 | B2 * | 4/2006 | Dryer et al. | 102/373 |
| 7,025,000 | B1 * | 4/2006 | Wong et al. | 102/481 |
| 7,059,251 | B1 * | 6/2006 | Khanna et al. | 102/282 |
| 7,124,690 | B1 * | 10/2006 | Tadros et al. | 102/370 |

FOREIGN PATENT DOCUMENTS

| | | |
|---|---|---|
| FI | 34 994 | 2/1966 |
| FR | 1 555 804 | 12/1967 |

* cited by examiner

*Primary Examiner*—Michelle Clement
(74) *Attorney, Agent, or Firm*—Ladas and Parry LLP

(57) ABSTRACT

The invention relates to an increment charge (4) to be placed around a tail shaft of a fin-stabilized mortar projectile (1), the increment charge (4) having a centrally located space for the tail shaft and a mounting opening in the space for mounting the increment charge (4). On the opposite side of the increment charge (4) there is provided a protrusion that fits into the mounting opening of an adjacent increment charge (4) for locking them in relation to each other.

16 Claims, 3 Drawing Sheets

INCREMENT CHARGE FOR FIN-STABILIZED MORTAR PROJECTILE

BACKGROUND OF THE INVENTION

The invention relates to an increment charge for a fin-stabilized mortar projectile, the increment charge being provided with a substantially centrally located space for a tail shaft of the projectile to allow the increment charge to be mounted around the tail shaft, and with a mounting opening extending from the space to the edge of the increment charge, the opening being smaller in width than the tail shaft.

Fin-stabilized mortar projectiles typically have a tail shaft extending from the cartridge containing the actual explosive, the tail shaft being provided with guiding fins fixed thereto. There are typically four or more guiding fins, although their number may vary.

Inside the mortar tail shaft there is the usual propellant charge, which ignites upon firing and provides the projectile with a muzzle velocity of a certain magnitude, thus making the projectile fly in a predetermined manner.

Upon firing, the flight distance of these fin-stabilized mortar projectiles and thus their range can be controlled with different kinds of increment charges placed around the tail shaft of the projectile, the burning of the charges in the mortar barrel supplying added propulsion force to the projectile. By using increment charges of different type and different burning properties, it is possible to control the desired flight distance.

In prior art solutions increment charges are mostly round in shape so that they fit into a mortar barrel. Moreover, the increment charges have a mounting opening on one side to allow the tail shaft of the projectile to be pushed into a centrally located space of the increment charge the shape of which substantially corresponds to that of the tail shaft.

A problem with prior art increment charges is that they cannot be used in solutions in which the projectiles are kept in a separate ammunition cassette or holder and fed with a mechanical feeding device into the mortar barrel. The reason for this is that due to the mass of the increment charges, vibration causes them to set into a position in which their mounting opening faces upward and thus the increments may come off and drop. The possibility that an increment charge may come off is such a major risk factor in the handling of this type of ammunition that it cannot be allowed. Further, the increment charges are in different positions and therefore burn unevenly in the barrel, which may cause harmfully great variations also in the trajectories of the projectiles.

BRIEF DESCRIPTION OF THE INVENTION

It is an object of the present invention to provide an increment charge that can be used also in solutions in which projectiles are stored in and fed into a mortar barrel by means of a mechanical feeding device.

The increment charge of the invention is characterized in that in the direction of thickness of the increment charge, i.e. on opposite sides of the increment charge mounted in place in the longitudinal direction of the projectile, there is provided a protrusion that can be placed inside the mounting opening of an adjacent increment charge so that adjacent increment charges mounted in place around the tail shaft of the projectile are locked non-rotatably in relation to one another and, at the same time, to the projectile.

An essential idea of the invention is that the increment charge is provided with locking members on both sides thereof, i.e. with protrusions on opposite sides of the increment charge in the direction of thickness thereof, which fit into a mounting opening of an adjacent increment charge and lock adjacent increment charges mounted in place non-rotatably in relation to each other such that the mounting openings of adjacent increment charges face different directions. According to a preferred embodiment of the invention the protrusions lock the increment charges mounted in place non-rotatably in relation to the tail shaft. According to a second preferred embodiment of the invention, at least one of the protrusions is provided with a groove into which a guiding fin of the projectile tail fits for locking an increment charge mounted in place non-rotatably in relation to the tail shaft of the projectile, thereby locking the entire increment charge assembly non-rotatably in relation to the projectile. According to a third preferred embodiment of the invention, the protrusion is dimensioned to fit between two adjacent guiding fins, thereby locking the increment charge closest to the tail non-rotatably in relation to the tail shaft of the projectile and the entire increment charge assembly non-rotatably in relation to the projectile.

An advantage of the invention is that increment charges mounted to a projectile stay in substantially predetermined positions in relation to each other and cannot come off due to vibration or other handling. In addition, burning inside the barrel always takes place in substantially the same way. A further advantage is that projectiles provided with such increment charges can be handled mechanically and loaded from an ammunition cassette into the mortar barrel with a mechanical loading device, without any risk of them coming off.

BRIEF DESCRIPTION OF THE DRAWINGS

In the following, the invention will be described in greater detail with reference to the accompanying drawings, in which.

DETAILED DESCRIPTION OF THE INVENTION

Figure 1:
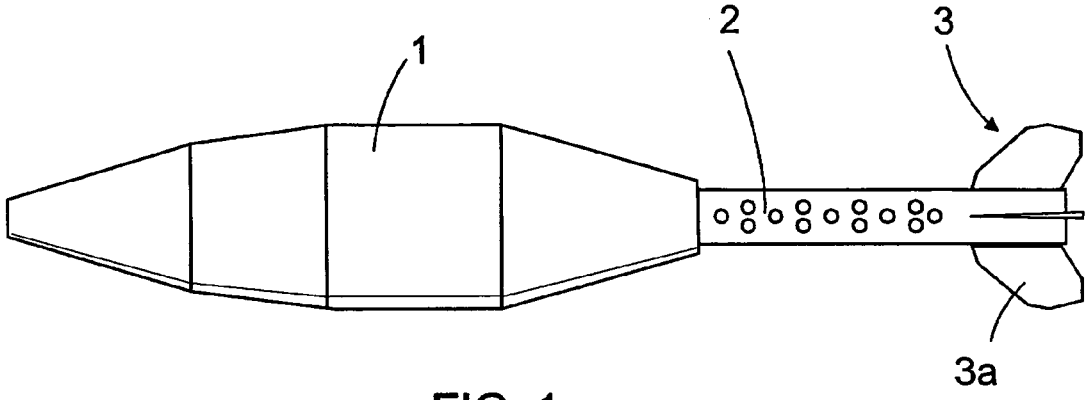
FIG. 1 is a schematic view of a conventional mortar projectile.
Figure 2A:
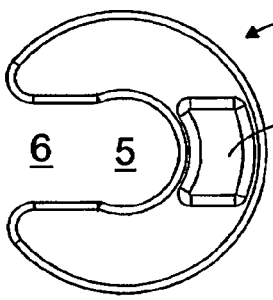
FIGS. 2*a* to 2*e* are schematic views of an embodiment of an increment charge of the invention.
Figure 2B:
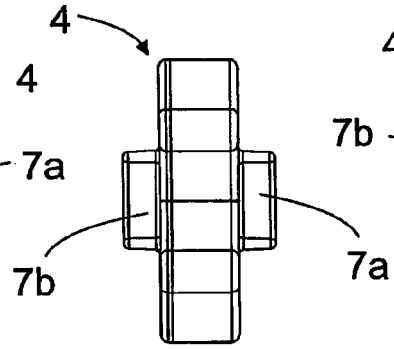
Figure 2C:
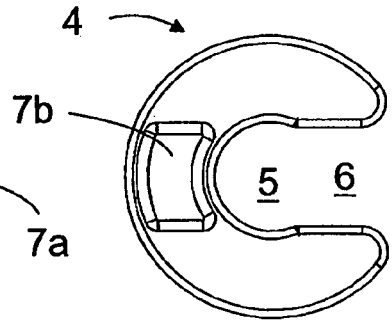
Figure 2D:
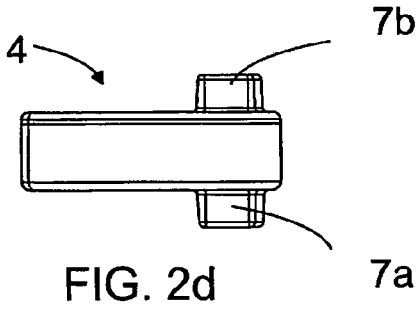
Figure 2E:
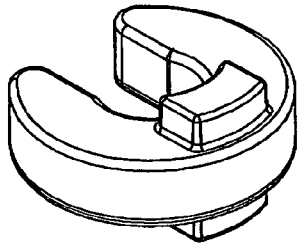
Figure 3A:
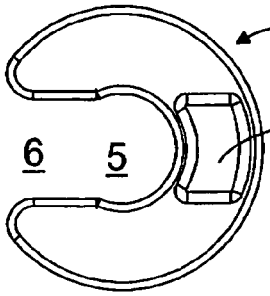
FIGS. 3*a* to 3*e* are schematic views of a second embodiment of the increment charge of the invention.
Figure 3B:
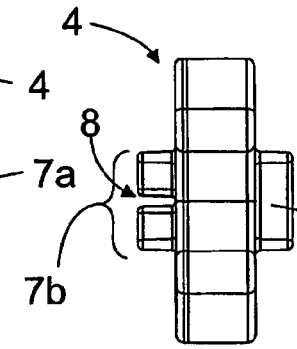
Figure 3C:
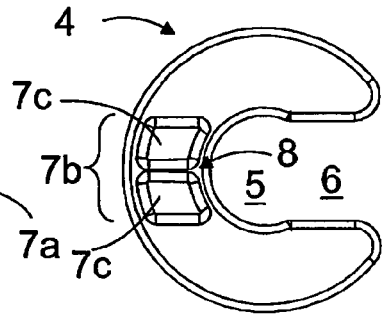
Figure 3D:
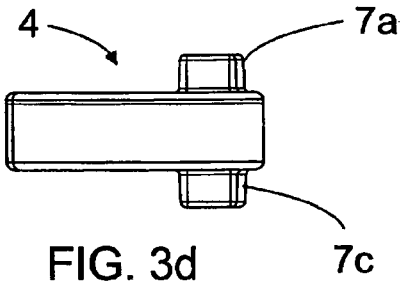
Figure 3E:
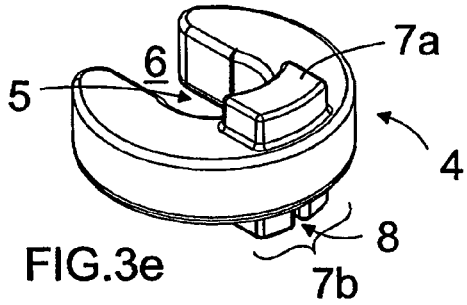

FIG. 1 is a schematic view of a mortar projectile. The projectile comprises an actual projectile part 1 containing explosive material and having a tail shaft 2 connected thereto, the tail shaft containing the actual propellant charge, and the rear end of the tail shaft 2 being provided with a tail 3 having guiding fins 3*a*.

FIG. 2 is a schematic view of an embodiment of an increment charge of the invention. The increment charge 4 has an outer shape allows it to fit into the mortar pipe. In its simplest form, its shape resembles a circle, as shown in FIG. 2, but it can be of any other shape, too, provided that it fits into the mortar barrel with the projectile. Consequently, its greatest outer dimension may be equal to the diameter of the projectile at the most. The increment charge 4 has a centrally located, typically mainly round space 5, which is substantially of the same shape as the tail shaft 2 and into which the tail shaft 2 fits. The space 5 has a mounting opening 6 leading to one edge of the increment charge, through which opening the tail shaft 2 of the projectile can be pushed when mounting the increment charge 4 onto the tail shaft 2 of the projectile. The mounting opening 6 is slightly smaller than the diameter of the tail shaft 2 so that when the tail shaft 2 is in the centrally located space 5 of the increment charge 4, the increment charge 4 stays on the tail shaft 2.

Further, on both sides in the direction of thickness of the increment charge 4, i.e. on the upper side and the under side of the increment mounted in the longitudinal direction of the projectile, there are provided protrusions 7*a* and 7*b* acting as locking members. In relation to the mounting opening, the protrusions 7*a* and 7*b* are most preferably substantially symmetrically on opposite sides of the increment charge. When increment charges 4 are placed one on top of the other, the protrusions 7*a* and 7*b* fit into the mounting openings 6 of other increment charges 4, the protrusions 7*a* and 7*b* and the mounting openings 6 thus locking the superimposed increment charges 4 non-rotatably in relation to one another. With all the increment charges 4 mounted around the tail shaft 2, which is described below with reference to FIG. 5, the increment charges 4, i.e. the entire increment charge assembly, are locked into a substantially fixed whole. By using locking members of a suitable shape and size, an entity is achieved that does not rotate about the tail shaft 2 of the projectile in any circumstances. The protrusions 7*a* and 7*b* are preferably dimensioned in such a way that when pushed into a mounting opening 6 of an adjacent increment charge 4, they are pressed against the inner surfaces of the mounting opening 6 such that the increment charges 4 are engaged to each other and become locked in their direction of thickness, i.e. when mounted in place in the length direction of the projectile, by impact of friction and press force. Moreover, the increment charges are locked on both sides in relation to the diameter of the increments, i.e. the protrusions of two adjacent increment charges 4 set into each other's mounting opening, whereby the locking forces acting on opposite sides of the increment charges in relation to their diameters are substantially symmetrical.

FIG. 3 is a schematic view of a second increment charge of the invention. In this embodiment, which otherwise corresponds to the increment charge of FIG. 2, protrusion 7*b* is provided with a groove 8. The groove 8 is meant to be used in such a way that when an increment charge 4 closest to the tail of the projectile is pushed in place, it is set into a position in which one of the guiding fins 3*a* sets into the groove 8, thereby locking the increment charge and the entire increment charge assembly non-rotatably in relation to the projectile. The groove 8 may be of a suitable shape and depth, depending on the projectile to be used, and in an extreme case the groove 8 divides the protrusion 7*b* in two protrusion portions 7*c* located at a distance from one another.

Instead of being placed symmetrically, the protrusions 7*a* and 7*b* may also be asymmetrically positioned, in which case superimposed increment charges are rotated at a specific angle in relation to one another. In this embodiment only the protrusion 7*b* may be provided with a groove 8, although both the grooves 7*a* and 7*b* could have a similar groove as well. Further, it is also possible to implement this embodiment without any grooves at all, in which case the protrusion is shaped to fit between two adjacent guiding fins and to thereby lock the increment charge non-rotatably in relation to the tail and the entire projectile. Likewise, it is possible to shape the protrusions shown in the embodiment of FIG. 3 such that they fit between two adjacent guiding fins 3*a*.

Figure 4:
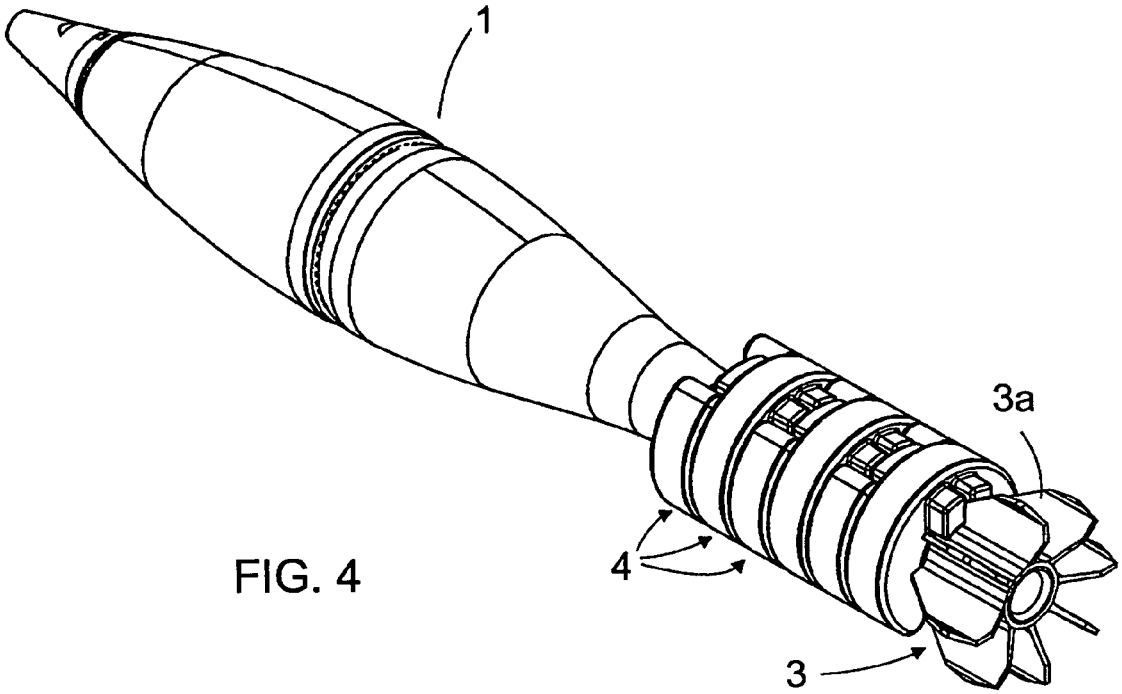
FIG. 4 is a schematic view of a mortar projectile provided with the increment charge of the invention.

FIG. 4 is a schematic view of a mortar projectile with an increment charge assembly mounted in place. As shown in FIG. 4, increment charges 4 are placed around the tail shaft 2 so that they cover the tail shaft 2 substantially entirely and are not able to become detached from each other in the longitudinal direction of the projectile so as to be disengaged from the protrusion of an adjacent increment charge 4. FIG. 4 further shows how the groove 8 in the protrusion 7*b* is set onto the guiding fin 3*a* such that the guiding fin 3*a* is left between portions of the protrusion 7*b* on both sides of the groove 8, and thus preventing the increment charge 4 from rotating in relation to the projectile. Since the rest of the increment charges are correspondingly locked to adjacent increment charges, the entire increment charge assembly is non-rotatably around the tail shaft 2 of the projectile. As a result, the projectile can be stored in different types of cassettes or other projectile holders without the increment charges 4 being able to rotate in relation to the projectile in a such way that their mounting openings would face upward and the projectiles could come off the tail shaft by impact of vibration.

Figure 5:
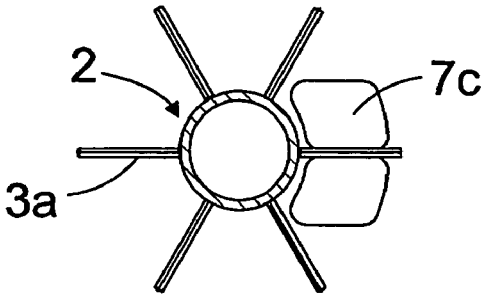
FIG. 5 is a schematic view of a protrusion of an increment charge of FIG. 2 in relation to the tail fins of a projectile.

FIG. 5 is a schematic view of the position of the increment charge protrusion 7*b* provided with a groove in relation to the guiding fin of the projectile tail, when seen from the direction of the projectile nose. It shows a tail 3 provided with guiding fins 3*a*. It also shows a cross-section of a tail shaft 2 and the increment charge protrusion 7*b*. The groove 8 on the protrusion 7*b* coincides with a guiding fin 3*a*, the protrusion 7*b* thus setting on both sides of the guiding fin 3*a*. Since the increment charge assembly mounted in place prevents the protrusion 7*b* from moving away from the tail in the axial direction of the projectile, the protrusion 7*b* locks the increment charge assembly in relation to the guiding fin 3*a* of the tail.

Figure 6:
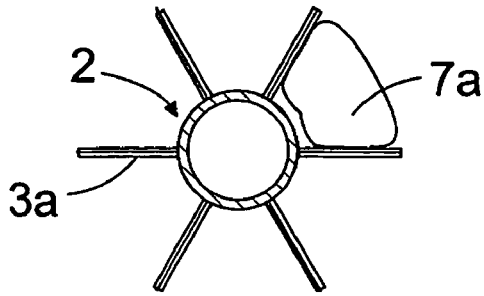
FIG. 6 is a schematic view of the location of a protrusion of an increment charge of FIG. 3 in relation to the tail of the projectile.

FIG. 6, in turn, shows an embodiment of the increment charge in which the protrusion 7 is shaped to fit between two adjacent guiding fins 3*a* of the projectile. FIG. 6 is similar to FIG. 5, except that it shows how the protrusion 7*b* is located between two guiding fins 3*a*. Similarly as in the embodiment of FIG. 5, the protrusion 7*b* locks the increment charge and thereby the entire increment charge assembly non-rotatably in relation to the guiding fins 3*a* and thereby the entire increment charge assembly is locked non-rotatably in relation to the projectile.

In the above description and in the drawings the increment charge has been discussed as an integral unit, which is what it actually is. The increment charge can be implemented in various ways and thus it may be manufactured by casting or pressing it from a certain type of inflammable material suitable for a propellant charge. Further, the increment charge may be manufactured by providing it with a casing made of a suitable inflammable material, such as nitrocellulose, that sustains handling and by inserting a suitable amount of gunpowder or other material suitable for the purpose into the casing.

Figure 7:
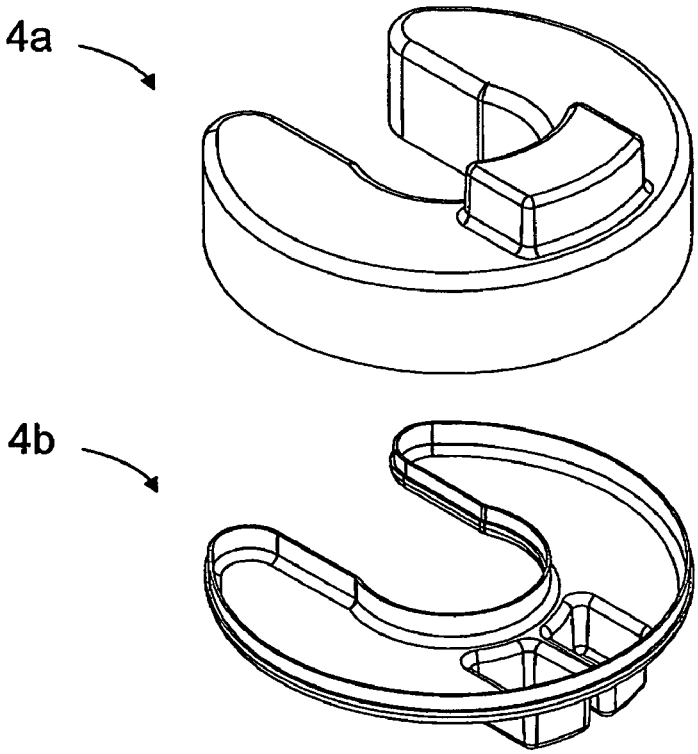
FIG. 7 is a schematic view of an embodiment of the increment charge with its parts shown in perspective.

FIG. 7 illustrates the latter implementation with a schematic view of an embodiment of the increment charge 4, its parts being shown in perspective. In this embodiment, the increment charge 4 has a casing consisting of two parts 4*a* and 4*b* made of a suitable material, such as nitrocellulose, for example by pressing, drawing, or casting. The manufacture of this type of propellant charge provided with a casing is known per se and therefore it does not need to be described in greater detail in this context.

Into the cover 4*a* of the propellant charge 4 is placed a desired amount of suitable propellant 4*b*, such as gunpowder, and the parts 4*a* and 4*b* of the casing are then fixed together. By varying the quality and amount of the gunpowder inside the increment charge 4, it is possible to produce increment charges 4 of different force and yet identical in outer appearance and purpose of use. Thus by using increment charges of different forces, it is possible to control the trajectory of the projectile in different ways.

The invention has been described in the above specification and in the drawings only by way of example, the invention not being in any way restricted thereto. What is essential is that there is at least one protrusion on both sides of the increment charges so that superimposed increment charges are locked non-rotatably in relation to each other by means of locking members, such as protrusions and mounting openings of the increment charges. According to a preferred embodiment the protrusions are shaped and dimensioned such that the entire increment charge assembly is locked non-rotatably around the projectile by means of the protrusions and the guiding fins of the tail.

The invention claimed is:

1. An increment charge for mounting to a fin-stabilized mortar projectile, the increment charge comprising:

a U-shaped body having a U-shaped upper side and a U-shaped lower side, the U-shaped body defining a substantially centrally located space and a mounting opening extending from the space to an edge of the increment charge to allow the increment charge to be mounted around a substantially cylindrical tail shaft of a mortar projectile having guiding fins adjacent to the tail shaft, the opening being smaller in width than the centrally located space;

a first protrusion protruding above the U-shaped upper side of the U-shaped body and a second protrusion protruding above the U-shaped lower side of the U-shaped body opposite the first side; each of the first and second protrusions being dimensioned to be receivable by the mounting opening such that the first and second protrusions can be received by a mounting opening of an identical adjacent increment charge when the centrally located spaces of the increment charges are aligned with one another; wherein the first protrusion is dimensioned with respect to the mounting opening such that the first protrusion can be tightly fitted within an inner surface of a mounting opening of an adjacent like increment charge so that the increment charges can become locked in relation to one another.

2. An increment charge according to claim 1, wherein the first and second protrusions are disposed on the upper and lower sides in a substantially symmetrical relation with respect to the mounting opening.

3. An increment charge according to claim 2, wherein the first protrusion is dimensioned with respect to the mounting opening such that the first protrusion can be tightly pressed against an inner surface of an mounting opening of an identical adjacent increment charge so that the increment charges can become locked in relation to one another.

4. An increment charge according to claim 1, wherein the second protrusion of the increment charge is provided with a groove extending radially outwardly alone a radius of the increment charge.

5. An increment charge according to claim 4, wherein all protrusions of the increment charge are provided with a groove extending radially outwardly along a radius of the increment charge.

6. An increment charge according to claim 4, wherein the protrusion is formed of two protrusion portions located at a distance from one another, the groove being formed between the two protrusion portions.

7. A fin-stabilized mortar projectile comprising:

a tail shaft;

guiding fins; and an increment charge according to claim 1 mounted on the tail shaft, wherein the second protrusion is dimensioned to fit between two adjacent guiding fins of the projectile, thereby locking the increment charge in a non-rotatable relation to the tail shaft of the projectile and to the projectile.

8. An increment charge according to claim 7, wherein the protrusions of the increment charge are substantially similar in shape.

9. An increment charge according to claim 1, wherein the first and second protrusions of the increment charge are substantially similar in shape.

10. An increment charge according to claim 1, wherein the increment charge has a casing made of an inflammable material with gunpowder or other material suitable for a propellant charge inside the casing.

11. An increment charge according to claim 10, wherein the inflammable material is nitrocellulose.

12. An increment charge according to claim 1, wherein the mounting opening and at least one of the protrusions are dimensioned so that the mounting opening can accommodate two of the protrusions therein.

13. An increment charge according to claim 1, wherein the first protrusion has one or more grooves for receiving therein one or more of the guiding fins of the projectile, and the second protrusion does not have a groove for receiving therein one or more of the guiding fins of the projectile.

14. In first and second increment charges each having a U-shaped body defining a space therethrough for mounting the increment charge on a tail shaft of a fin-stabilized mortar projectile and a mounting opening extending from the space to an edge of the increment charge for admitting the tail shaft to the space, the improvements comprising:

the first and second increment charges each comprising a first protrusion protruding above a first side of the U-shaped body and a second protrusion protruding above a second side of the U-shaped body opposite the first side; the first protrusion of the first increment charge being constructed and arranged to be received by the mounting opening of the second increment charge and the second protrusion of the first increment charge being constructed and arranged to engage one or more stabilizing fins of the projectile so as to lock the increment charge in a non-rotatable relation with respect to the projectile.

15. The increment charges according to claim 14, wherein the first protrusion of the first increment charge has one or more grooves for receiving therein one or more of the guiding fins of the projectile, and the second protrusion of the first increment charge does not have a groove for receiving therein one or more of the guiding fins of the projectile.

16. A fin-stabilized mortar projectile comprising:

a tail shaft;

guiding fins; and a plurality of increment charges mounted next to one another on the tail shaft, each of the increment charges including a U-shaped body and defining a mounting opening;

wherein a first of the increment charges is mounted adjacent the guiding fins, and includes a first protrusion above a first side of the U-shaped body and a second protrusion above a second side of the U-shaped body;

wherein a second of the increment charges is mounted on the tail shaft adjacent the first of the increment charges, and includes a first protrusion above a first side of the U-shaped body and a second protrusion above a second side of the U-shaped body;

wherein the first protrusion of the first increment charge is provided with a groove that engages one of the guiding fins thereby locking the first increment charge in a non-rotatable relation with respect to the projectile;

wherein the second protrusion of the first increment charge is received by the mounting opening of the second increment charge; and wherein the first protrusion of the second increment charge is received by the mounting opening of the first increment charge.

* * * * *